United States Patent [19]

Wippich

[11] 4,112,716

[45] Sep. 12, 1978

[54] PADLOCK DEVICE

[75] Inventor: Joachim Wippich, Campbell, Calif.

[73] Assignee: Research Machine & Development, Inc., Santa Clara, Calif.

[21] Appl. No.: 687,515

[22] Filed: May 18, 1976

[51] Int. Cl.[2] ..... E05B 67/02; E05B 67/22

[52] U.S. Cl. ..... 70/38 C; 70/39; 70/49; 70/52

[58] Field of Search ..... 70/32, 33, 34, 38 R, 70/38 A, 38 B, 38 C, 39, 49, 52

[56] References Cited

U.S. PATENT DOCUMENTS

| | | | |
|---|---|---|---|
| 2,070,012 | 2/1937 | Jacobi | 70/52 |
| 2,419,213 | 4/1947 | Hines | 70/38 A |
| 2,983,133 | 5/1961 | Hruby | 70/39 X |
| 3,581,530 | 6/1971 | Raspadori | 70/38 R |
| 3,735,612 | 5/1973 | Popouici | 70/38 A |

FOREIGN PATENT DOCUMENTS

| | | | |
|---|---|---|---|
| 359,098 | 9/1922 | | 70/38 R |
| 810,961 | 8/1951 | Fed. Rep. of Germany | 70/38 R |
| 413,238 | 4/1946 | Italy | 70/33 |

*Primary Examiner*—Robert L. Wolfe
*Attorney, Agent, or Firm*—Schatzel & Hamrick

[57] ABSTRACT

A padlock device including a unitary, elongated, cylindrical metal body having spring loaded shackle elements extending into one end thereof and a key-locking cylinder assembly extending into the other end. Rounded recesses are formed along the sides of the cylindrical body and the shackle pin holes are arranged so that the pins respectively extend through the recesses. The locking cylinder includes a pawl mechanism which engages notches in the ends of the shackle pins for locking the pins in the closed position.

11 Claims, 9 Drawing Figures

PADLOCK DEVICE

BACKGROUND OF THE INVENTION

1. Field of the Invention

The present invention relates generally to locking apparatus and more particularly to an improved padlock device which is constructed in such a manner as to make it unusually difficult to physically violate.

2. Description of the Prior Art

Heretofore, most padlocks of both the keyed and combination variety have utilized a U-shaped shackle as the means of joining chains, cables, hasp-type locks and the like. Although such locks are quite suitable for many light security applications, the fact that the locking shackle is exposed makes it vulnerable to intentional destruction since it can usually be quickly sawed through or snipped in two using heavy duty cutters.

SUMMARY OF THE PRESENT INVENTION

It is therefore a principal objective of the present invention to provide a novel padlock device having recessed shackle elements which are not readily accessible to sawing and cutting tools.

Briefly, a preferred embodiment of the present invention includes a unitary, elongated, cylindrical metal body having spring loaded shackle elements extending into one end thereof and a key-locking cylinder assembly extending into the other end. Rounded recesses are formed along the sides of the cylindrical body and the shackle pin holes are arranged so that the pins respectively extend through the recesses. The locking cylinder includes a pawl mechanism which engages notches in the ends of the shackle pins for locking the pins in the closed position.

An important advantage of the present invention is that the padlock body is made of a unitary block of metal which is internally machined to provide receptacles for the operative components of the device and the shackle pins are substantially concealed by the body and the chain links or other means to which the shackle pins are attached.

These and other objects and advantages of the present invention will no doubt become apparent to those of ordinary skill in the art after having read the following detailed description of the preferred embodiment which is illustrated in the several figures of the drawing.

IN THE DRAWING

DETAILED DESCRIPTION OF THE PREFERRED EMBODIMENTS

Figure 1:
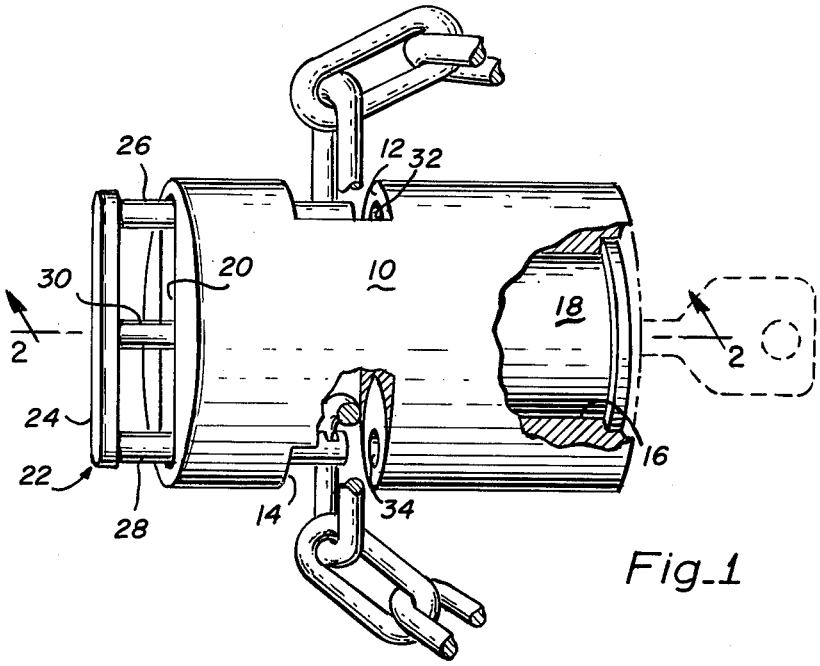
FIG. 1 is a partially broken perspective view illustrating a padlock device in accordance with the present invention.
Figure 2:
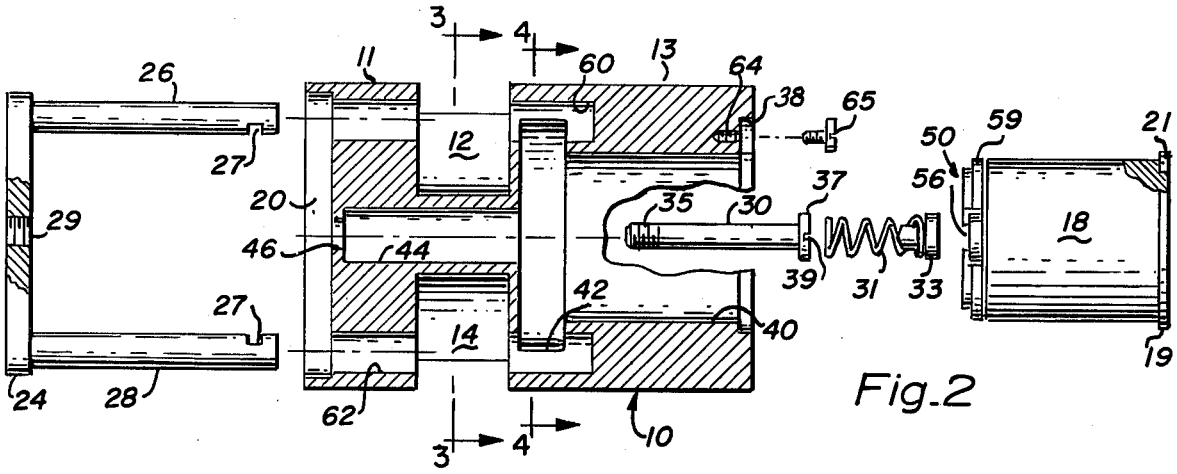
FIG. 2 is a partially broken and sectioned view taken along the line 2—2 and exploded to the various components of the padlock illustrated in FIG. 1.

Referring now to FIGS. 1 and 2 of the drawing, there is shown a first embodiment of a padlock device in accordance with the present invention which includes an elongated cylindrical body 10 having two semicylindrical recesses 12 and 14 cut into opposite sides thereof, a large bore 16 extending into one end thereof for receiving a key lock cylinder 18, and an elongated slot 20 formed in the other end thereof with three bores 46, 60 and 62 (see FIG. 2) extending longitudinally into the body along the slot. Additional bores 42 and 44 communicate bores 46 and 60 with bore 40.

A shackle pin assembly 22 is also included which is comprised of an elongated bar 24, a pair of shackle pins 26 and 28 and a spring loaded stop pin 30. Shackle pins 26 and 28 are suitably secured to the ends of bar 24 and have facing notches provided in the sides of the distal ends thereof. Stop pin 30 is threaded at one end to mate with a threaded aperture 29 in bar 24 and is provided with a head at the other end which serves as a means for keeping that end of the pin centered in bore 44. Alternatively, pin 30 could be press fit into bar 24.

As will be further explained below, when the shackle assembly is in the locked position, the shackle pins 26 and 28 are extended through the recesses 12 and 14, and into the openings 32 and 34 so that the notches 27 can be engaged by the locking mechanism 50 to hold the shackle assembly 22 in position with the bar 24 flush within the slot 20.

Figure 3:
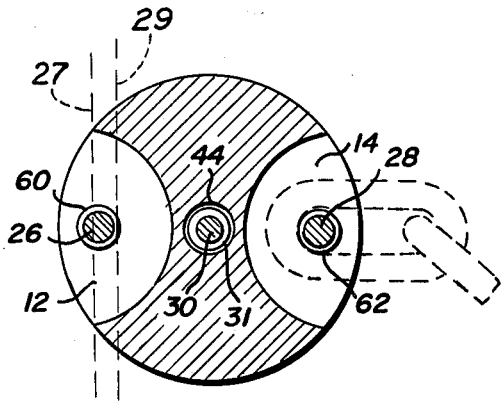
FIG. 3 is a cross section taken along the line 3—3 of the padlock device illustrated in FIGS. 1 and 2.

In order to use the device to lock, for example, two chain ends together, one would merely unlock by turning the key shown in dashed lines to allow the shackle assembly to be spring-biased into an open position with the ends of pins 26 and 28 nearly clearing the recesses 12 and 14. The chain links would then be inserted into the recesses 12 and 14 (see also FIG. 3), and the shackle assembly would be depressed so that the pins 26 and 28 pass through the chain links and back into apertures 32 and 34. The key would then be turned to lock the shackle assembly in place. Since the pins 26 and 28 are disposed within the recesses 23 and 24, they are not easily accessible to sawing and are clearly not accessible to ordinary bolt cutting tools and the like and are thus substantially more secure than in prior art devices. For example, if one were to attempt to cut the pin 26 with a saw or file, as illustrated by the dashed line 27 in FIG. 3, he would also have to cut into the body 10 as illustrated by the dashed line 29 in order to sever the pin. Moreover, since in this embodiment pins 26 and 28 are rigidly connected together by the bar 24 and both pins are individually locked, it would be necessary to either make cuts both above and below the chain link or to make a single cut through both of the pins.

In FIG. 2 of the drawing, the internal structure of body 10 and the nature of the other components of the device are illustrated in detail. Body portion 10 is made from a solid cylindrical member having five axially-extending concentric bores 38, 40, 42, 44, and 46 provided therein. The bores 38 and 40 are respectively for receiving the flange 19 and body of the key lock cylinder 18. The bore 42 provides a locking chamber for accommodating the latching assembly 50 to be described below, and the bores 44 and 46 are for receiving the stop pin 30 and its associated compression spring 31.

The unthreaded end of pin 30 is provided with a round head 37 which is of a diameter suitable for mating with the diameter of bore 44. Head 37 is provided with a suitable slot or other female drive coupling 39.

The pair of bores 60 and 62 extend longitudinally from the bottom of the slot 20 through the body end portion 11, the recesses 12 and 14 and into the body portion 13. Note also that the bores 60 and 62 extend through peripheral portions of the bore 42. A tapped and countersunk opening 64 is provided in the rightmost end of body 10 for receiving a screw 65 the head of which mates with a notch 21 in cylinder flange 19 to lock the cylinder 18 within the bore 40.

To assemble the mechanism, the shackle pins 26 and 28, which are preassembled to the bar 24 are extended into the bores 60 and 62, and the stop pin 30 is extended through the bores 44 and 46. A suitable driving tool is then mated with the female socket 39 in head 37 and used to turn the pin 30 until the end 35 is fully threaded into the mating threaded aperture 29 in bar 24. Spring 31 and nylon plug 33 are inserted into bore 44 behind head 37, and cylinder 18 is then inserted into bore 40 to complete the assembly. Note that plug 33 bears against the flat top of cam 56 when the device is assembled. Alternatively, threads could be provided at the end of bore 44 and plug 33 could be threaded to mate therewith so as to free cam 56 from any forces applied thereto by spring 31.

Figure 4:
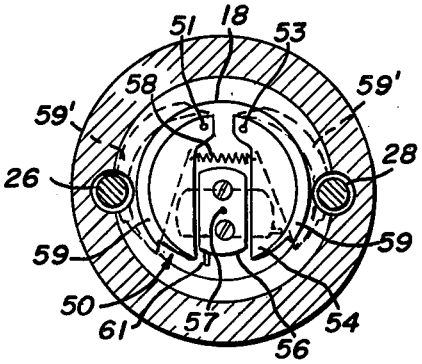
FIG. 4 is a cross section taken along the line 4—4 of the padlock device illustrated in FIGS. 1 and 2.

Referring now to FIG. 4 of the drawing, the latching mechanism 50 is illustrated and includes a pair of pawls 52 and 54 which are pivotally connected to the end of the lock cylinder 18 at the points 51 and 53 respectively. The pawls 52 and 54 (see also FIG. 2) are of a first thickness over most of the body but are of a reduced thickness about their periphery to form locking lips 59. A double-ended cam 56 is attached by means of screws or other fasteners to the end of the rotating keyway of lock cylinder 18 and pivots about the axis illustrated by the dot 57. When in the position indicated by the solid lines, the tension spring 58 holds the pawls 52 and 54 in contact with the side surfaces of cam 56 so that the outer diameter of the pawls is the same as that of the body of lock cylinder 18 thereby enabling it to be inserted or removed from the bore 40 of housing 10. However, upon turning the keyway in the counterclockwise direction (as illustrated in FIG. 4) cam 56 will cause pawls 52 and 54 to be rotated outwardly about their respective pivot pins into the positions indicated by the dashed lines 59' so that the lips 59 (see also FIG. 2) engage the notches 27 of the shackle pins 26 and 28 thereby holding the shackle assembly in the locked position. Note that cam 56 also includes a limit pin 61 which, as indicated by the dashed lines, prevents the cam from rotating more than 90°.

Figure 5:
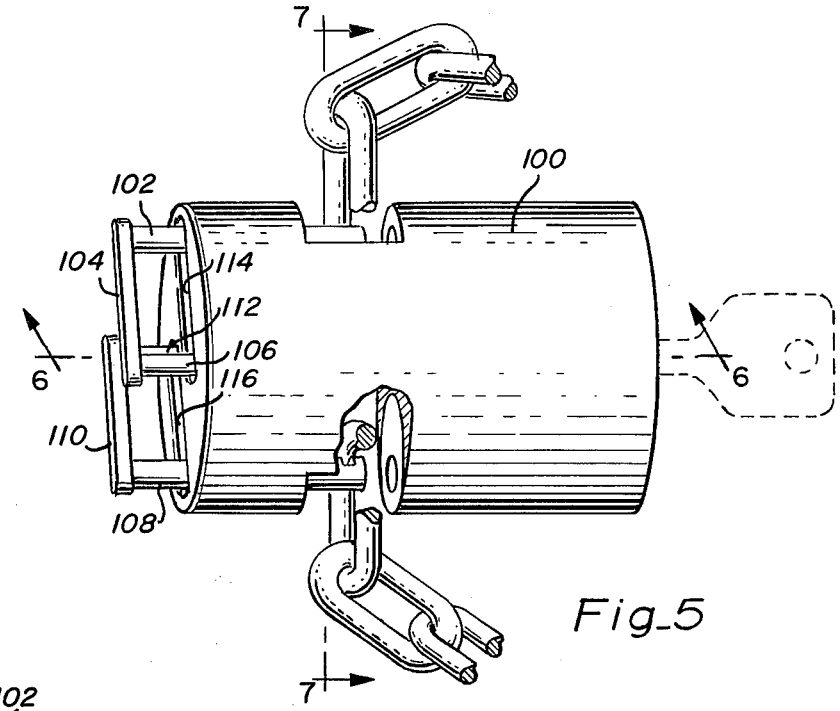
FIG. 5 is a partially broken perspective view showing an alternative embodiment of the present invention.

Referring now to FIGS. 5 through 9, an alternative embodiment of the present invention is illustrated which permits either one or the other of the shackle pins, or both simultaneously, to be locked or unlocked. As illustrated in FIG. 5, the shackle pin 102 is attached to a bar 104 having a stop pin 106 attached to its other end. Similarly, the shackle pin 108 is attached to one end of a bar 110 having its other end attached to a stop pin 112. Slotted recesses 114 and 116 are provided in the end of cylinder 100 for receiving bars 104 and 110 respectively.

Figure 6:
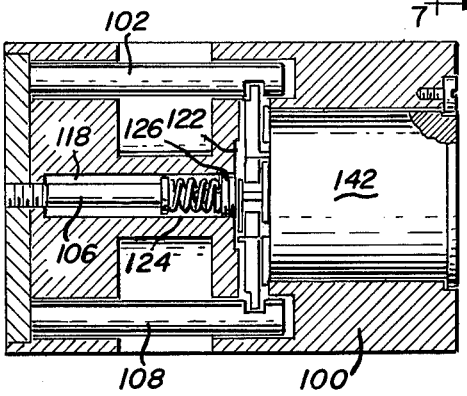
FIG. 6 is a cross section taken along the lines 6—6 of FIGS. 5 and 7.
Figure 7:
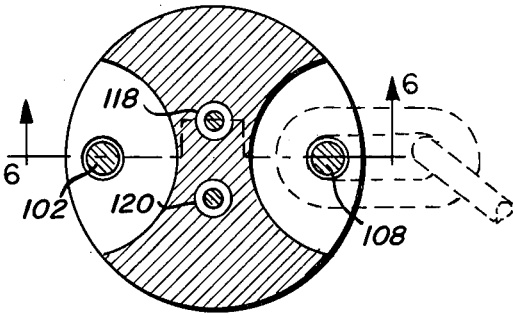
FIG. 7 is a transverse section taken along the line 7—7 of FIG. 5.

The primary difference between this embodiment and the previous embodiment, insofar as the body 100 is concerned, is that the bores 118 and 120 (see FIG. 7) for receiving stop pins 106 and 112 are drilled off the center of body 100 and an additional bore 122 may be provided internally to accommodate the camming structure to be described below. In FIG. 6 a cross section taken along the line 6—6 of FIG. 7 is shown with the shackle pins 102 and 108 in the locked position. This cross section also illustrates the bore 118 which receives stop pin 106 and a spring 124. Note also in this embodiment that threaded plugs 126 are threaded into the ends of bores 118 and 120 behind spring 124.

Figure 8:
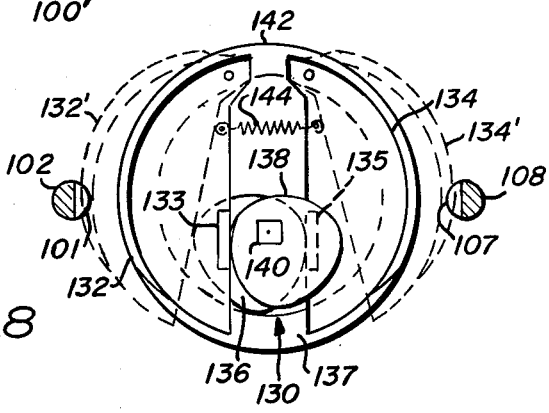
FIGS. 8 and 9 are respectively plan and sectioned profile views diagrammatically illustrating the structure and operation of the latching mechanism of embodiments illustrated in FIG. 5.
Figure 9:
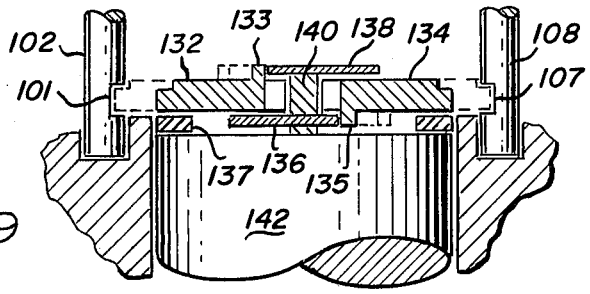

In order to enable the alternative locking and unlocking of the respective shackle pins, the dual cam mechanism 130 illustrated in FIGS. 8 and 9 is used to selectively move the pawls 132 and 134. The cam mechanism 130 is comprised of an inner lobe 136 and an outer lobe 138, both of which are affixed to a shaft 140 that is in turn affixed to the rotatable keyway of lock cylinder 142. In this embodiment pawl 132 is provided with an upstanding pad 133 for bearing against the outer lobe 138 and pawl 134 has a downwardly extending pad 135 for bearing against the inner lobe 136. In order to provide clearance for lobe 136 a spacer ring 137 is positioned between the end of cylinder 142 and the bottom surfaces of pawls 132 and 134.

The inner and outer cam lobes 136 and 138 are shaped such that when in the position illustrated in FIG. 8 they allow the spring 144 to pull the lobes into the retracted position shown by the solid lines 132 and 134. When the shaft 140 is turned 90° in the clockwise direction, pawl 132 is rotated into the extended position shown by the dashed lines 132' so as to lockingly engage the notch 101 in shackle pin 102. During this increment of rotation, cam 136 causes no change in position of pawl 134. However, during the next 90° of rotation of shaft 140 in the clockwise direction, pawl 132 will be held in the extended position and pawl 134 will be moved to the extended position illustrated by the dashed lines 134' to engage notch 107 to pin 108.

The third 90° of rotation will cause pawl 132 to return to its retracted position with pawl 134 remaining in its extended position. The last increment of rotation will cause pawl 132 to remain in its retracted position and pawl 134 to move into its retracted position. Rotation of shaft 140 in the counterclockwise direction causes the pawls to move in a reverse sequence.

It will thus be appreciated that by turning the key in one direction or the other a selected one of the shackle pins can be released without affecting the other, and a simple continued turning will release the other. Such embodiment would obviously be suited for applications wherein it is desirable that one of the shackles be left affixed to one portion of the chain to support the locking mechanism while freeing the other shackle to release the end of the chain. Similarly, where a single lock is used to tie the end of one chain to the end of another chain as in side-by-side gateways or the like, the lock could be fastened to a center support and used to release one or the other or both of the chains simultaneously.

Although the present invention has been described above with relation to two particular preferred embodiments, it is contemplated that many alterations and modifications will become apparent to those skilled in the art after having read the above description. It is therefore intended that the appended claims be interpreted as covering all such alterations and modifications as fall within the true spirit and scope of the invention.

What is claimed is:

1. A padlock device comprising:

an elongated unitary body having a first bore extending longitudinally into one end thereof, a second bore extending longitudinally into the other end thereof and in communication with a first side portion of said first bore, a first recess formed in a side of said body and located such that the axis of said second bore passes therethrough, said first recess having an external perimeter formed such that said axis of said second bore lies internal of any line connecting opposite sides of said perimeter, a third bore extending longitudinally into said other end of said body and in communication with a second side portion of said first bore, and a second recess formed in another side of said body and located such that the axis of said third bore passes through a central portion thereof;

a lock cylinder adapted to fit within said first bore and having a first laterally movable pawl capable of being extended at least part way into said second bore, a second laterally movable pawl capable of being extended at least part way into said third bore, and a first eccentric cam for engaging said first pawl and a second eccentric cam for engaging said second pawl, said cams being joined and rotatable together and being configured such that rotation thereof through a first angle causes said first pawl to be moved into said second bore and rotation through a second angle causes said second pawl to be moved into said third bore; and shackle means including first and second elongated shackle pins each having a notch provided in one side near distal ends thereof, said pins being respectively disposed within said second and third bores and movable between a first position in which said distal ends respectively extend completely through said first and second recesses so that said notches can be engaged by said first and second pawls, and a second position wherein said distal ends extend less than half way through said first and second recesses, the distal end portions of said pins being partially enclosed by and thus protectively shielded by the portions of said body surrounding said recesses.

2. A padlock device as recited in claim 1 wherein said shackle means further includes spring loading means for biasing said shackle pins in the direction of said second positions.

3. A padlock device as recited in claim 2 wherein said shackle means further includes limit stop means for preventing said biasing means from causing said shackle pins to move beyond said second positions.

4. A padlock device as recited in claim 1 wherein said shackle means further includes means coupling said shackle pins together so that they move as a unit.

5. A padlock device comprising:

an elongated unitary body having a first bore extending longitudinally into one end thereof, a second bore extending longitudinally into the other end thereof and in communication with a first side portion of said first bore, a first recess formed in a side of said body and located such that said second bore passes through a central portion thereof, a third bore extending longitudinally into said other end of said body and in communication with a second side portion of said first bore, and a second recess formed in another side of said body and located such that said third bore passes through a central portion thereof;

a lock cylinder adapted to fit within said first bore and having a first laterally movable pawl capable of being extended at least part way into said second bore and a second laterally movable pawl capable of being extended at least part way into said second bore; and shackle means including first and second elongated shackle pins each having a notch provided in one side near first ends thereof, said pins being respectively disposed within said second bore and said third bore and movable between first positions in which their first ends extend completely through said recesses and said notches are engaged by said first and second pawls, and second positions wherein their first ends extend less than half way through said recesses, said shackle pins being movable independent of each other, and said shackle means further including spring loading means for independently biasing said pins toward their respective second positions.

6. A padlock device as recited in claim 5 wherein said lock cylinder includes a rotatable cam for engaging and causing said first pawl to extend into said second bore as said cam is rotated.

7. A padlock device as recited in claim 1 wherein said first and second pawls lie in a common plane, said first cam lies on one side of said plane and said second cam lies on the other side of said plane.

8. A padlock device as recited in claim 5 wherein said lock cylinder includes rotatable cam means for engaging and causing said first and second pawls to extend into said second and third bores respectively as said cam is rotated.

9. A padlock device as recited in claim 8 wherein said cam means includes a first eccentric cam for engaging said first pawl and a second eccentric cam for engaging said second pawl, said cams being joined and rotatable together and being configured such that rotation thereof through a first angle causes said first pawl to be moved and rotation through a second angle causes said second pawl to be moved.

10. A padlock device as recited in claim 9 wherein said first and second pawls lie in a common plane, said first cam lies on one side of said plane and said second cam lies on the other side of said plane.

11. A padlock device as recited in claim 5 wherein said lock cylinder includes rotatable cam means for engaging and causing said first and second pawls to extend into said second and third bores respectively as said cam is rotated.

* * * * *